United States Patent [19]

Nowack et al.

[11] 4,314,901

[45] Feb. 9, 1982

[54] CATALYTIC HYDRODESULFURIZATION OF AN ORGANIC SULFUR COMPOUND CONTAINED IN GASOLINE

[75] Inventors: Gerhard P. Nowack; Marvin M. Johnson, both of Bartlesville, Okla.

[73] Assignee: Phillips Petroleum Company, Bartlesville, Okla.

[21] Appl. No.: 169,010

[22] Filed: Jul. 15, 1980

[51] Int. Cl.[3] ..... C10G 45/04

[52] U.S. Cl. ..... 208/216 R; 208/236

[58] Field of Search ..... 208/216 R, 216 PP, 236

[56] References Cited

U.S. PATENT DOCUMENTS

| | | | |
|---|---|---|---|
| 2,891,003 | 6/1959 | Chervenak et al. | 208/216 R |
| 3,637,877 | 1/1972 | Nowack et al. | 585/272 |
| 3,810,830 | 5/1974 | Van Klinken et al. | 208/216 T |
| 3,859,202 | 1/1975 | Brunn et al. | 208/216 R |
| 3,860,511 | 1/1975 | Brunn et al. | 208/216 R |
| 3,876,531 | 4/1975 | Brunn et al. | 208/216 R |
| 3,957,625 | 5/1976 | Orkin | 208/211 |
| 4,049,542 | 9/1977 | Gibson et al. | 208/216 R |

OTHER PUBLICATIONS

The Oil and Gas Journal, v. 75, No. 32, Aug. 8, 1977, p. 36.

*Primary Examiner*—Delbert E. Gantz
*Assistant Examiner*—Olik Chaudhuri

[57] ABSTRACT

The catalytic hydrodesulfurization of an organic sulfur compound contained in gasoline is carried out in the presence of a catalyst composition comprising catalytic grade alumina and a catalytic component at least one member of which is selected from the group consisting of molybdenum and tungsten. A catalytic promoter may also be present in the catalyst composition with at least one member of the catalytic promoter being selected from the group consisting of iron, cobalt and nickel. A suitable nitrogen compound is also contacted with the catalyst composition to at least partially suppress the saturation of olefins in the gasoline during the hydrodesulfurization process.

10 Claims, No Drawings

CATALYTIC HYDRODESULFURIZATION OF AN ORGANIC SULFUR COMPOUND CONTAINED IN GASOLINE

This invention relates to an improved catalytic process for the hydrodesulfurization of organic sulfur compounds contained in gasoline. In one aspect, this invention relates to a method for at least partially suppressing the saturation of olefins contained in gasoline during a hydrodesulfurization process. In another aspect, this invention relates to a method for reducing the consumption of hydrogen in a hydrodesulfurization process.

Hydrodesulfurization is a process intended primarily to convert the sulfur in organic sulfur compounds to hydrogen sulfide. The hydrogen sulfide can be removed from the feedstream after the hydrodesulfurization process. Hydrodesulfurization is typically utilized to remove sulfur from gasoline to give a product which, when burned, will meet environmental standards.

The earliest hydrodesulfurization catalysts were bauxite and fuller's earth. Later, catalysts containing cobalt molybdate on alumina and nickel tungstate on alumina substantially replaced the earlier catalyst and these catalysts are still used very extensively.

Gasoline that is made by the catalytic cracking of heavier petroleum fractions contains significant concentrations of olefins. When the petroleum that is fed to the catalytic cracker contains sulfur, the gasoline that is produced also contains sulfur. The sulfur concentration in gasoline must be extremely low in order to meet environmental standards. It is thus necessary to reduce the concentration of the sulfur in the gasoline to the extent possible. Hydrodesulfurization is commonly utilized to accomplish this. However, hydrodesulfurization of organic sulfur compounds contained in gasoline may also result in the saturation of the olefins contained in the gasoline. This is undesirable because of the resulting reduction in the octane number of the gasoline and because substantial hydrogen is consumed in the saturation of the olefins.

It is thus an object of this invention to provide an improved catalytic process for the hydrodesulfurization of organic sulfur compounds contained in gasoline by at least partially suppressing the saturation of olefins in the gasoline during the hydrodesulfurization process to thereby reduce the consumption of hydrogen in the hydrodesulfurization process and reduce the loss in octane number for the treated gasoline.

In accordance with the present invention, gasoline containing organic sulfur compounds is contacted under suitable conditions with a catalytic grade alumina to which a catalytic component has been added. At least one member of the catalytic component is selected from the group consisting of molybdenum and tungsten. A catalytic promoter may also be added to the catalytic grade alumina. At least one member of the catalytic promoter is selected from the group consisting of iron, cobalt and nickel.

A nitrogen compound is introduced with the gasoline. The presence of the nitrogen compound at least partially reduces the saturation of the olefins in the gasoline to thereby reduce the quantity of hydrogen consumed in the hydrodesulfurization process and also provide gasoline having a reduced sulfur content without substantial reduction of the octane number.

Other objects and advantages of the invention will be apparent from the foregoing brief description of the invention and the appended claims, as well as the detailed description of the invention which follows.

Any suitable organic sulfur compound may be hydrodesulfurized in accordance with the present invention. Suitable organic sulfur compounds include sulfides, disulfides, mercaptans, thiophenes, benzothiophenes, and the like and mixtures of any two or more thereof.

The term gasoline as used herein refers to the 65°-430° F. hydrocarbon fraction. This hydrocarbon fraction may be obtained from processes such as catalytic cracking, dehydrocyclization, alkylation, pentane isomerization and hexane isomerization. The invention is particularly directed to reducing the concentration of sulfur in gasoline that is made by the catalytic cracking of heavier petroleum fractions. Such gasoline contains a significant concentration of olefins. Gasoline produced in a catalytic cracking process will also generally contain a much higher sulfur concentration than gasoline produced by other process. Thus, in general, the gasoline stream treated by the process of the present invention will be made up primarily of gasoline produced by catalytic cracking.

The gasoline may contain any concentration of sulfur. However, typically the concentration of sulfur will not exceed about 0.3 weight percent based on the weight of the gasoline.

Preferably the fluid stream treated by the process of the present invention will consist only of gasoline. However, other hydrocarbon fractions may be present in small concentrations and other materials such as conventional additives may be present if desired.

The hydrodesulfurization catalyst employed in the process of the present invention is a catalyst composition comprising catalytic grade alumina to which a catalytic component, at least one member of which is selected from the group consisting of molybdenum and tungsten, has been added. A promoter may also be present in the catalyst composition. At least one member of the promoter is selected from the group consisting of iron, cobalt and nickel. Generally, both the catalytic component and the promoter will be present in the catalyst composition in the oxide form.

Any suitable concentration of the oxides of molybdenum and tungsten may be utilized. The total concentration of the oxides of molybdenum and tungsten will preferably be in the range of about 8 to about 27 weight percent based on the total catalyst weight. Any suitable concentration of the oxides of iron, cobalt and nickel may be utilized. The total concentration of the oxides of iron, cobalt and nickel will preferably be in the range of about 2 to about 8 weight percent based on the total catalyst weight.

Some examples of suitable catalysts which are commercially available are set forth in Table I.

TABLE I

| Company | Code | % CoO | % NiO | % $MoO_3$ |
|---|---|---|---|---|
| American Cyanamid | HDS-20A | 5.0 | — | 16.2 |
| American Cyanamid | HDS-3A | — | 3.6 | 15.2 |
| American Cyanamid | HDS-3S | 2.5 | 2.5 | 15.5 |
| Nalco | Nalcomo-477 | 3.3 | — | 14.0 |
| Nalco | Nalcomo-479 | 4.4 | — | 19.0 |
| Nalco | Nalcomo-484 | 5.0 | — | 18.5 |
| Nalco | NM-502 | — | 4.0 | 14.0 |
| Nalco | NM-506 | — | 6.7 | 27.0 |
| Shell | Shell-344 | 2.9 | — | 13.6 |
| Shell | Shell-444 | 3.7 | — | 13.3 |
| Ketjen | Ketjenfine-165 | 5.0 | — | 16.0 |
| Ketjen | Ketjenfine 153-S | — | 3.0 | 15.0 |

TABLE I-continued

| Company | Code | % CoO | % NiO | % $MoO_3$ |
|---|---|---|---|---|
| United Catalysts | Co—Mo | 3.4 | — | 13–15 |
| United Catalysts | Ni—Mo | — | 3.4 | 13–15 |
| Harshaw | HT-400E | 2.7 | — | 13.7 |

Preferably, the catalyst composition is presulfided, although the catalyst composition may be allowed to become sulfided during the hydrodesulfurization process. The catalyst may be presulfided by any conventional method. Generally, the catalyst is treated with a mixture of hydrogen sulfide in hydrogen at a temperature of about 400° F. until hydrogen sulfide is detected in the effluent flowing from the reactor.

Any suitable nitrogen compound may be utilized in the process of the present invention. Examples of suitable nitrogen compounds include ammonia; ammonia compounds; acyclic, cyclic aliphatic, aromatic, primary, secondary or tertiary amines; heterocyclic nitrogen compounds; and other nitrogen compounds such as hydrazine and ethylenediamine. Particular compounds are methylamine, ethylamine, n- or iso-propylamine, butylamine, cyclohexylamine, aniline, methylethylamine, dibutylamine, and diamylamine, triethylamine, tripropylamine, tributylamine, pyridine, quinoline, and isoquinoline.

For reasons of economy, ammonia or ammonium compounds are the preferred form of the nitrogen compound. It is also presently preferred that the nitrogen compound possess a volatility which is at least as great as the least volatile fraction of the gasoline that is being processed.

The nitrogen compound may be contacted with the catalyst composition at any rate suitable for suppressing the saturation of olefins. The nitrogen compound is preferably contacted with the catalyst composition at a rate in the range of about 0.1 to about 2.0 and more preferably in the range of about 0.2 to about 1.0 milliequivalents of nitrogen compound per hour per gram of catalyst composition to provide a suitable suppression of the saturation of olefins. This may be accomplished by dissolving the nitrogen compound in the gasoline or may be accomplished by dissolving the nitrogen compound in a suitable solvent such as water and introducing the thus dissolved nitrogen compound with the gasoline. In general, if the nitrogen compound is dissolved in gasoline, the concentration of the nitrogen compound in the gasoline will be in the range of about 0.01 M to about 1.0 M and will more preferably be in the range of about 0.05 M to about 0.5 M. In general, if the nitrogen compound is dissolved in water, the concentration of the nitrogen compound in the water will be in the range of about 0.1 molar to about saturation.

The process of this invention can be carried out by means of any apparatus whereby there is achieved a contact with the catalyst composition of the organic sulfur compounds to be hydrodesulfurized. The process is in no way limited to the use of a particular apparatus. The process of this invention can be carried out using a fixed catalyst bed, fluidized catalyst bed, or moving catalyst bed. Presently preferred is a fixed catalyst bed.

Any suitable hydrodesulfurization conditions may be utilized in the process of the present invention. Generally, the conditions under which gasoline may be hydrodesulfurized without undergoing extensive hydrogenation are milder with respect to pressure and temperature than are hydrodesulfurization processes for heavier feedstocks. The preferred conditions are those wherein the pressure, temperature and feed rate have just attained the severity required to effect substantially complete olefin saturation and hydrodesulfurization of the organic sulfur compounds if the addition of the nitrogen compound were omitted.

Any suitable temperature for hydrodesulfurization of the organic sulfur compounds over the catalyst composition can be utilized. The temperature will generally be in the range of about 275° C. to about 400° C. and will more preferably be in the range of about 285° C. to about 345° C.

Any suitable pressure for the hydrodesulfurization of the organic sulfur compounds over the catalyst composition can be utilized. In general, the pressure will be in the range of about 0.4 MPa to about 7 MPa where the total pressure system is defined as the sum of the partial pressure of the feedstock plus the partial pressure of the added hydrogen. Preferably, the total system pressure will be in the range of about 1 MPa to about 4 MPa.

Any suitable quantity of hydrogen can be added to the hydrodesulfurization process. The quantity of hydrogen added to the hydrodesulfurization process will generally be in the range of about 50 to about 900 volumes of hydrogen at standard conditions per volume of feed. More preferably, the quantity of hydrogen added to the process will be in the range of about 90 to about 400 volumes of hydrogen at standard conditions per volume of feed.

Any suitable flow rate for the feedstock of the present invention can be utilized. In general, the flow rate in terms of the volume of liquid per volume of catalyst per hour (LHSV) can range from about 0.1 to about 20 and will more preferably range from about 0.5 to about 3.

The following examples are presented in further illustration of the invention.

EXAMPLE I

This invention is illustrated by runs in which three different catalytic cracker gasolines and two different hydrodesulfurization catalysts were used. Pertinent properties of the gasolines used are given in Table II. Pertinent properties and the commercial designations of the catalysts utilized are given in Table III. Both the American Cyanamid catalyst and the Shell catalyst utilize high surface area alumina supports and are in the form of 1/16-inch extrudates.

TABLE II

| Gasoline | Boiling Range, °F. | Sulfur, wt. % | Bromine No. |
|---|---|---|---|
| A | Full ($C_5$-400) | 0.16 | 82 |
| B | Full ($C_5$-400) | 0.22 | 57 |
| C | 185–400 | 0.22 | 58 |

TABLE III

| Catalyst | Promoters | Bulk Density g/cc | S.A., $m^2/g$ |
|---|---|---|---|
| American Cyanamid HDS-3A | 3.6 NiO, 15.2 $MoO_3$ | 0.641 | 180 |
| Shell 344 | 2.9 CoO, 13.6 $MoO_3$ | 0.78 | 187 |

Runs were made in a 1-inch inside diameter by 27-inch long stainless steel reactor. The reactor contained a thermowell in which four thermocouples indicated the temperature along the catalyst bed which occupied approximately the central one-third of the reactor. The catalyst was supported on a layer of alpha-alumina pills and was also covered by a layer of alpha-alumina pills. The reactor was mounted vertically in an electrically-heated, temperature controlled furnace. Reactants passed downflow through the reactor. The rate of addition of gasoline was observed by the rate of removal of gasoline from a graduated buret with an adjustable pump. The rate of addition of hydrogen to the reactor was established prior to beginning a run by regulating the rate of addition of hydrogen with a fine metering valve and measuring the flow rate with a wet test gas meter. The total system pressure in the reactor was regulated with a flow controller manufactured by Moore Products. The reaction products flowing from the reactor were cooled in a water-cooled condenser. The thus cooled reaction products were passed to a gas-liquid separator packed in ice. The liquid reaction products from the gas-liquid separator were analyzed for sulfur content and for bromine number.

The hydrodesulfurization catalysts were presulfided prior to introducing the gasoline into the reactor. The hydrodesulfurization catalysts were presulfided utilizing one of two methods, either of which was considered to be suitable. In one presulfiding method, the hydrodesulfurization catalysts were heated to about 400° F. in hydrogen only. The thus-heated hydrodesulfurization catalysts were then contacted with a gaseous mixture containing hydrogen and hydrogen sulfide in a mol ratio of about $2H_2:H_2S$ for about 1 hour while the hydrodesulfurization catalyst remained at about 400° F. Temperature of the hydrodesulfurization catalyst was then increased to about 600° F. for about 1 hour while the flow of the mixture of hydrogen and hydrogen sulfide was continued.

The second method of presulfiding the hydrodesulfurization catalyst involved contacting the hydrodesulfurization catalyst with a gaseous mixture containing hydrogen and hydrogen sulfide in a mol ratio of about $2H_2:H_2S$ while the catalyst was at a temperature of about 70° F. The flow of the gaseous mixture containing hydrogen and hydrogen sulfide was maintained while the temperature of the catalyst was raised to 600° F. The temperature of the catalyst was maintained at about 600° F. for about 1 hour.

With larger industrial reactors, the presulfiding process would require more time and the temperature would be limited to about 400° F. to prevent damage to the catalyst. The presulfiding step could be continued until the reactor effluent contained about 1000 ppm of $H_2S$.

Table IV presents the results from five runs in which an amine was added to the gasoline flowing to the reactor together with 5 comparable runs in which a nitrogen compound was not added to the gasoline flowing to the reactor. The range of temperatures set forth in Table IV does not indicate that temperature was changing during a run. The range of temperatures indicate that the catalyst was not being heated uniformly, due to furnace gradients and to exothermic hydrogenation reactions. Process conditions are considered to be of comparable severity within the pairs of runs being compared. Gasoline samples in which the sulfur concentration was below 0.01 weight percent (the limit of detection for the method employed) are shown to be 99 percent desulfurized. Concentration of sulfur in the gasoline samples was determined by X-ray fluorescence.

In run #2 ammonia was added as the anhydrous compound dissolved in gasoline. In the other runs (#4, 6, 8, 9) the nitrogen compound was added as an aqueous solution of ammonia having the concentration shown in Table IV.

TABLE IV

| Run | Catalyst | Temp., °F. | Pres., kPa | Gasoline | Gasoline LHSV | Vol. $H_2$/Vol. gasoline hr. | Meq. $NH_3$/hr g catalyst | Form of $NH_3$ | % HDS | % Olefins Saturated |
|---|---|---|---|---|---|---|---|---|---|---|
| 1 | HDS-3A | 518–609 | 1480 | A | 1.3 | 370 | 0 | None | 99 | 98 |
| 2 | " | 525–565 | " | | 1.4 | 385 | 0.22 | anh. $NH_3$ | 99 | 66 |
| 3 | HDS-3A | 588–595 | 793 | A | 1.3 | 350 | 0 | None | 84 | 59 |
| 4 | " | 593–604 | " | | 2 | 270 | 0.16 | 0.5 N in $H_2O$ | 86 | 33 |
| 5 | Shell 344 | 549–562 | 793 | B | 2 | 140 | 0 | None | 99 | 75 |
| 6 | " | 564–570 | " | | 2.34 | 150 | 0.34 | 0.5 N in $H_2O$ | 99 | 49 |
| 7 | HDS-3A | 546–568 | 793 | C | 2 | 125 | 0 | None | 99 | 91 |
| 8 | " | 591–605 | 41 | | 2 | 130 | 0.32 | 0.5 N in $H_2O$ | 99 | 59 |
| 9 | HDS-3A | 495–516 | 448 | A | 1.25 | 335 | 0.88 | 2.5 N in $H_2O$ | 50 | 13 |
| 10 | " | 497–516 | " | | 1.25 | 325 | 0 | None | 63 | 13 |

Comparison of the first four pairs of runs in Table IV indicates that the saturation of olefins was significantly retarded by the presence of the nitrogen compound while the hydrodesulfurization activity remained substantially equal for each pair of runs. Run 10 was a continuation of Run 9 in which the addition of aqueous $NH_4OH$ had been discontinued for about 24 hours before the gasoline sample of Run 10 was collected. A comparison of Run 9 with Run 10 demonstrates that the effect of adding the nitrogen compound to the hydrodesulfurization catalyst persists for a substantial time.

Reasonable variations and modifications are possible within the scope of the disclosure and the appended claims to the invention.

That which is claimed is:

1. A process for the catalytic hydrodesulfurization of an organic compound contained in a gasoline comprising the 65° F.–430° F. hydrocarbon fraction produced by the catalytic cracking of heavier hydrocarbon fractions, wherein said gasoline contains olefis, said process comprising the steps of:

contacting a suitable nitrogen compound and said gasoline under suitable hydrodesulfurization conditions with a catalyst composition comprising catalytic grade alumina and a catalytic component at least one member of which is selected from the group consisting of molybdenum and tungsten, wherein the rate at which said catalyst composition is contacted with said suitable nitrogen compound is in the range of about 0.1 to about 2.0 milliequivalents of said suitable nitrogen compound per hour per gram of said catalyst composition.

2. A process in accordance with claim 1 wherein the rate at which said catalyst composition is contacted with said suitable nitrogen compound is in the range of about 0.2 to about 1.0 milliequivalents of said suitable nitrogen compound per hour per gram of said catalyst composition.

3. A process in accordance with claim 1 wherein said organic sulfur compound is selected from the group consisting of sulfides, disulfides, mercaptans, thiophenes, benzothiophenes and mixtures of any two or more thereof.

4. A process in accordance with claim 1 wherein said catalyst composition additionally comprises a catalyst promoter at least one member of which is selected from the group consisting of iron, cobalt and nickel.

5. A process in accordance with claim 1 wherein said suitable nitrogen compound is selected from the group consisting of ammonia and ammonium compounds.

6. A process in accordance with claim 1 wherein said suitable hydrodesulfurization conditions comprise a temperature in the range from about 275° C. to about 400° C., a total system pressure in the range from about 0.4 MPa to about 7 MPa, a hydrogen flow rate in the range of about 50 to about 900 volumes of hydrogen at standard conditions per volume of said gasoline, and a flow rate for said gasoline in the range from about 0.1 to about 20 liquid volumes of said gasoline per volume of said catalyst composition per hour.

7. A process in accordance with claim 1 wherein said suitable hydrodesulfurization conditions comprise a temperature in the range from about 285° C. to about 345° C., a total system pressure in the range from about 1 MPa to about 4 MPa, a hydrogen flow rate in the range of about 90 to about 400 volumes of hydrogen at standard conditions per volume of said gasoline, and a flow rate for said gasoline in the range from about 0.5 to about 3 liquid volumes of said gasoline per volume of said catalyst composition per hour.

8. A process in accordance with claim 1 wherein said suitable nitrogen compound is dissolved in said gasoline prior to contacting said suitable nitrogen compound and said gasoline with said catalyst composition.

9. A process in accordance with claim 1 wherein said suitable nitrogen compound is dissolved in a suitable solvent prior to contacting said suitable nitrogen compound with said catalyst composition.

10. A process in accordance with claim 9 wherein said suitable nitrogen compound is selected from the group consisting of ammonia and the ammonium compounds and said suitable solvent is water.

* * * * *

UNITED STATES PATENT AND TRADEMARK OFFICE

CERTIFICATE OF CORRECTION

PATENT NO. : 4,314,901

DATED : February 9, 1982

INVENTOR(S) : Gerhard P. Nowack et al

It is certified that error appears in the above—identified patent and that said Letters Patent is hereby corrected as shown below:

Claim 1, column 6, line 67, after "contains", "olefis" should be --- olefins --- .

Signed and Sealed this

*Third* Day of *August 1982*

[SEAL]

*Attest:*

GERALD J. MOSSINGHOFF

*Attesting Officer*

*Commissioner of Patents and Trademarks*